United States Patent [19]

Staub et al.

[11] 4,048,603

[45] Sept. 13, 1977

[54] VAPORIZATION COOLED TRANSFORMER

[75] Inventors: Fred W. Staub; Heinz Jaster, both of Schenectady, N.Y.

[73] Assignee: General Electric Company, Schenectady, N.Y.

[21] Appl. No.: 754,827

[22] Filed: Dec. 27, 1976

[51] Int. Cl.[2] ..... H01F 27/10

[52] U.S. Cl. ..... 336/57; 165/105; 174/15 R; 336/60; 336/61

[58] Field of Search ..... 336/55, 57, 58, 60, 336/61; 174/15 R; 165/105

[56] References Cited

U.S. PATENT DOCUMENTS 3,264,589 8/1966 Dutton ..... 336/60 X

*Primary Examiner*—Thomas J. Kozma

*Attorney, Agent, or Firm*—Paul R. Webb, II; Joseph T. Cohen; Jerome C. Squillaro

[57] ABSTRACT

A hermetically sealed vaporization chamber contains a vaporization cooled transformer to be cooled while dielectrically protected and two phase dielectric fluid comprising a liquid and a vapor. The transformer includes a plurality of cooling ducts extending vertically therethrough. The liquid, which resides at a bottom portion of the chamber and has a liquid level above the bottom of the chamber, is also distributed as a film which coats the top and the wall surfaces of the vertical ducts. A distribution pan with an outer rim is positioned above the transformer for receiving liquid condensate from said condenser. The rim portion of the distribution pan is provided with a plurality of apertures to distribute the liquid condensate uniformly as a film over the wall surfaces of the associated vertical ducts. At least one condensate make-up pump is provided for pumping liquid from the bottom portion of the chamber to the distribution pan.

3 Claims, 4 Drawing Figures

VAPORIZATION COOLED TRANSFORMER

This invention relates to vaporization cooled transformers, and more particularly, to such transformers with an improved liquid distribution system.

Closed, or hermetically sealed, film evaporation coolings systems employing two-phase fluid coolants have been proposed. In such systems the fluid coolant is distributed while in its liquid phase as a liquid film over a surface, or surfaces, of the apparatus to be cooled. Heat transfer from the heated surface of the apparatus to the liquid film evaporates the film thereby cooling the surface and the apparatus. Where the apparatus to be cooled is electrical in nature, such as, a transformer, the two-phase fluid coolant is a dielectric and, sometimes, an inert non-condensable dielectric gas is used in addition to the two-phase fluid. The inert non-condensable gas serves to maintain adequate system pressure and dielectric strength. In the above film evaporation cooling system, the vapor produced subsequently condenses and is redistributed as a liquid film over the surfaces of the apparatus to be cooled. The evaporation-condensation cycle causes a natural recirculation of the coolant. However, it has been found that the flowing liquid coolant cannot normally be maintained intact on smooth surfaces unless substantial liquid coolant is caused to flow in addition to the above discussed natural recirculation rate. If the rupture of the liquid film occurs, then large dry and therefore hot spots are formed on the surfaces to be cooled resulting in undesirably high temperatures. To reduce this undesirable situation, either excess liquid may be pumped to the cooling surfaces in addition to the condensate flow, or the apparatus to be cooled may be partially submerged in a pool of the liquid coolant.

In the U.S. Pat. No. 3,887,759 an evaporative cooling system is described which employs liquid film evaporation from grooved evaporator surface and a condensate make-up pump for circulating liquid. A perforated drip pan is shown as the liquid distribution means which is positioned above the heat producing electrical apparatus. The condensate make-up pump pumps additional liquid to the pan.

In U.S. Pat. No. 4,011,535 and entitled "Vaporization Cooled Transformer", there is described such a transformer with an improved liquid distribution system which includes a specific distribution pan with nozzles extending therefrom and an associated liquid dam positioned on the upper edges of the heating producing apparatus. The above patents are assigned to the same assignee as the present application.

The primary object of our invention is to provide a vaporization cooled transformer with an improved liquid distribution system.

In accordance with one aspect of the present invention, a vaporization cooled transformer includes an improved liquid distribution system which distributes the dielectric or cooling liquid in a predetermine fashion over the coils and the top of the core with minimal liquid hold-up.

These and various objects, features and advantages will be understood from the following descriptions taken in connection with the accompanying drawing in which.

Figure 1:
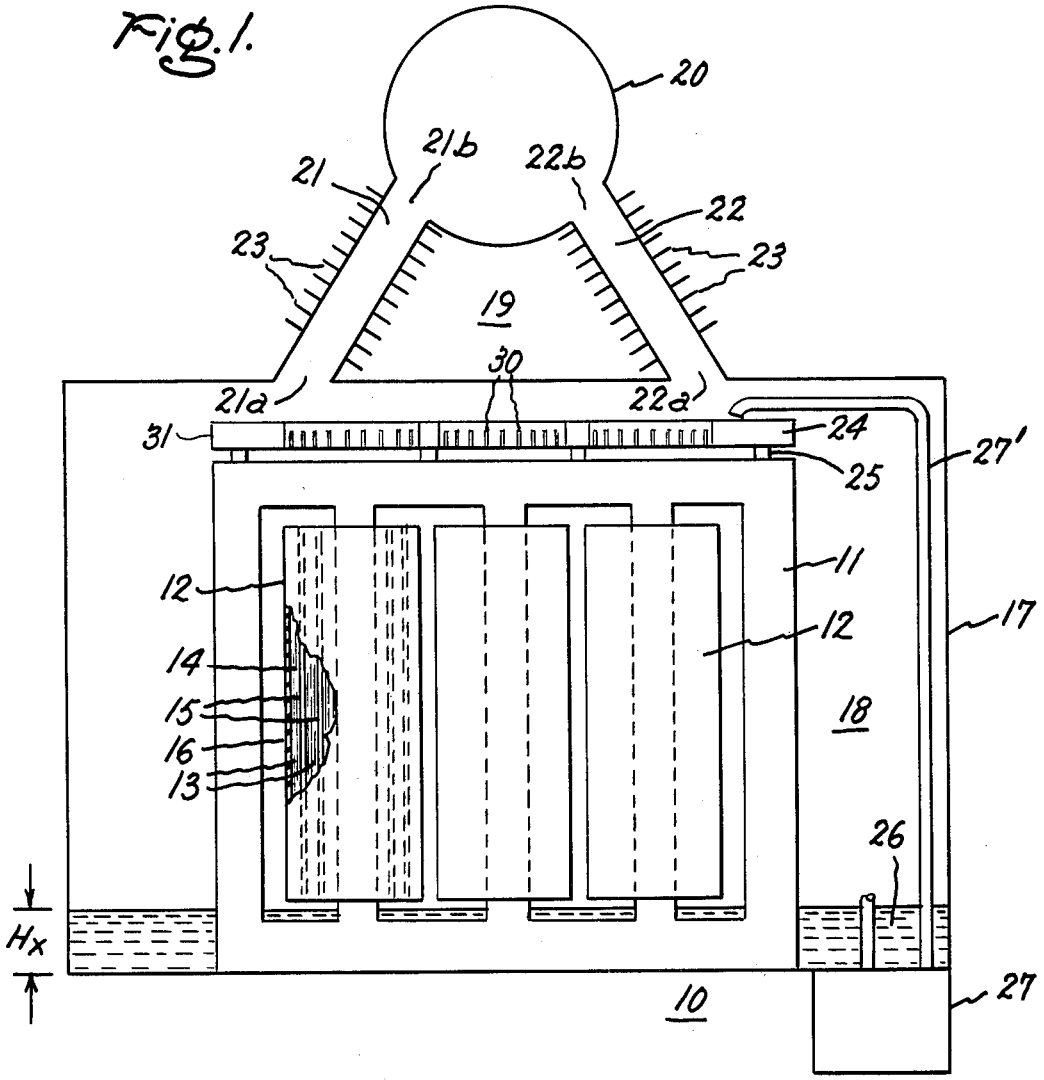
FIG. 1 is a schematic view of a vaporization cooled transformer made in accordance with our invention.

In FIG. 1 of the drawing, there is shown generally at 10, a vaporization cooled transformer made in accordance with our invention. Transformer 10 includes a transformer core 11 of laminated magnetic steel on which there are shown disposed three coils 12 each of which has conductor windings 13 embedded in an insulating material 14 and have a plurality of vertical ducts 15 therethrough. The cooling surfaces are core 11 and the walls of vertical ducts 15 which are placed at several radial and circumferential positions of windings 13. A layer of insulation 16 covers the exterior surface of the high voltage windings. Core 11 and insulated embedded windings 13 may be mounted on a suitable pedestal (not shown) of dielectric material within a casing 17. Core 11 and windings 13 are located with a vaporization chamber 18 of a transformer casing 17. A surface condenser 19 is coupled in series between chamber 18 of casing 17 and a gas-holding reservoir 20. The system including vaporization chamber 18, condenser 19 and gas-holding reservoir 20, form a closed or a hermetically sealed system. The system is charged with a mass of vaporizable dielectric liquid such as inert fluorocarbon, e.g., perfluoro-2-butyltetra-hydrofuran. The system is also charged with an inert non-condensable dielectric gas such as sulfur hexafluoride ($SF_6$). The fluorocarbon liquid coolant has a high dielectric strength. However, the dielectric strength of its vapor varies directly with its density. Accordingly, at low system temperatures when the vapor density is low, little dielectric protection is provided. Accordingly, a predetermined amount of non-condensable inert dielectric gas is charged into the system to regulate the system to regulate the system pressure for the purpose of maintaining the dielectric strength in the vapor phase in chamber 18 when the system temperature is low. It is to be understood that the aforementioned inert fluorocarbon liquid coolant and inert gas are specifically named herein as examples and that other liquid coolants and inert non-condensable gas may be employed.

Condenser 19 is illustrated as an air-cooled surface condenser comprising a plurality of condenser tubes, such as the tubes 21 and 22. Each of the tubes 21 and 22 may be provided with spaced cooling fins 23 which are connected to the outer wall surfaces of the tubes and, as is well known, such cooling fins promote heat transfer from the tubes. Tube 21 is open at both ends, **21*a* and 21*b*; the opening 21*a* serves as a vapor inlet as well as a condensate outlet port. As indicated, the tube opening 21*a* is coupled to and communicates with the top of the vaporization chamber 18. The tube opening 21*b* is coupled to and communicates with the gas-holding reservoir 20. Similarly, condenser tube 22 is open at both ends, 22*a* and 22*b*. The opening 22*a* serves as both a vapor inlet and condensate outlet port and is coupled to and communicates with the top of the vaporization chamber 18. The tube opening 22*b* is coupled to and communicates with the gas reservoir 20. There is mounted within vaporization chamber 18 near the top thereof and situated directly below the tube openings 21*a* and 22*a* an improved liquid distribution pan 24** which is arranged to receive conexiting from the openings 21*a* and 22*a* of the surface condenser 19. Pan 24 is positioned on top of core 11 and is electrically isolated from core 11 by electrically insulating stand-offs 25 or pan 24 is made of electrically insulating material. Pan 24 is dished or depressed midway its lower surface to provide containment for a head of dielectric liquid while minimizing the volume of liquid hold-up. A plurality of apertures 31 are selected to deliver a certain fraction of the total liquid flow on the top of the core and on the upper surfaces of the embedded conductor windings. Improved distribution pan 24 enables condensate collected therein to be distributed as a liquid film over the top of the core and over the wall surfaces of vertical coolings ducts 15 of the embedded windings 13. The excess liquid collects in a pool 26 or body of liquid in the bottom of vaporization chamber 18. Pool 26 of liquid coolant has the liquid level $H_x$ measured from the bottom of the chamber 18 of casing 17 which is adjusted to not fall below the top of pump 27.

Two condenser tubes 21 and 22 of surface condenser 19 have been shown diagrammatically. However, it is to be understood that more than, or less than, two condenser tubes may be employed for connecting the vaporization chamber 18 with the gas holding reservoir 20, depending on the heat transfer rate required for the specific purpose. As, for example, at median ambient design temperatures, the vaporizable dielectric liquid coolant pool 26 fills the bottom portion of vaporization chamber 18 of casing 17 to the level $H_x$ as indicated. Heat produced by transformer core 11 and embedded windings 13 vaporize the liquid film thereby cooling the transformer. The vapor moves upwardly in the vaporization chamber 18 and enters the condenser 19 through the inlet openings 21*a* and 22*a*. The non-condensable dielectric gas is normally largely confined in reservoir 20. The dielectric gas in effect, closes off the opposite ends 21*b* and 22*b* of the condenser tubes 21 and 22. With ends 21*b* and 22*b* closed by the gas, the vapor moves upwardly in the tubes 21 and 22 and condenses on the inner wall surfaces of these tubes. The condensate, thus formed, on the inner wall surfaces of the tubes 21 and 22 flows downwardly and ultimately exits as a liquid condensate from the openings 21*a* and 22*b* and collects in distribution pan 24. From pan 24, the condensate is distributed over the top of core 11 and the wall surfaces of vertical ducts 15. Thus, the condensate formed in the condenser tubes returns by gravity, in countercurrent flow relationship with the vapor in the tubes, to pan 24, where again by means of gravity, it is distributed over the top of core 11 and over the wall surfaces of vertical ducts 15 as a film. Subsequently, the heat producing transformer core 11 and embedded winding 13 again vaporize the liquid film thereby rejecting its heat. This vaporization-condensation cycle is repeated and the temperature of the transformer 10 is maintained within safe operating limits. There is also located within vaporization chamber 18 a condensate make-up pump 27 for recirculating condensate from pool 26 of the body of liquid back through delivery tube 27′ to pan 24. The inclusion of condensate make-up pump 27, such as, for example, a vapor push pump, is advantageous. Vapor push pumps are described, for example, in U.S. Pat. Nos. 3,819,301, 3,834,835, and 3,887,759, all of which patents are assigned the same assignee as this application. Without such a pump 27 to recirculate the condensate from pool 26 to pan 24, the only liquid return is by the process of vaporization and subsequent condensation cycle. In such a situation, a large mass of the transformer windings to be cooled must then be immersed in liquid 26.

Figure 2:
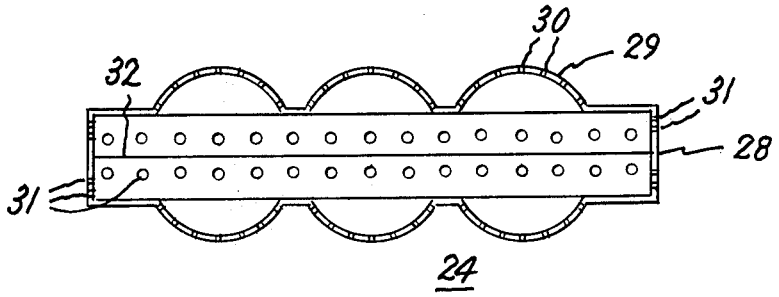
FIG. 2 is a top plan view of the liquid distribution pan which is shown in FIG. 1 of the drawing.

In FIG. 2 of the drawing there is shown a top plan view of liquid distribution pan 24 illustrated FIG. 1 of the drawing. Pan 24 has an outer rim 28 providing a container for condensate from both condenser 19 and pump 27. Opposite edges of pan 24 are each shown with three extended portions 29. Each extended portion 29 has its rim 28 provided with a number of apertures 30 for dielectric liquid distribution over the top of each coil 12 and over the wall surfaces of vertical cooling ducts 15 of embedded windings 13. Pan 24 has additional pan and rim apertures 31 at its opposite edges to provide dielectric liquid distribution to the top of core 11. Pan 24 is dished or depressed midway its lower surface as shown on its upper surface at 32 to provide containment for a head of dielectric liquid while minimizing the volume of liquid hold-up. Other pan configurations are useful to provide liquid containment but rapid flow to the apertured portions. The number and size of apertures 30 and 31 are so chosen to deliver a certain fraction of the total liquid flow on the top of the core and on the upper surface of the embedded conductor windings.

Figure 3:
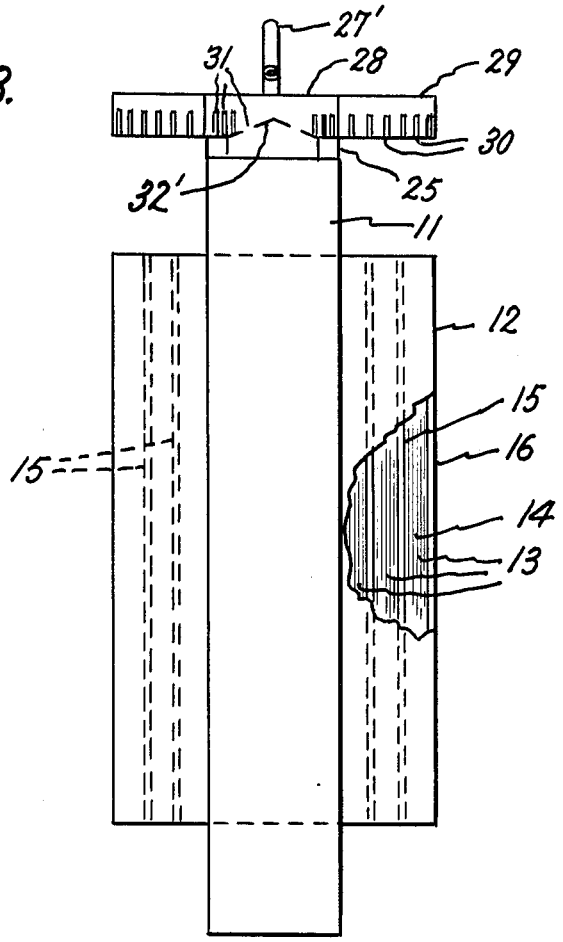
FIG. 3 is an end elevation view of the liquid distribution system of the vaporization cooled transformer shown in FIG. 1 of the drawing.

In FIG. 3 of the drawing there is shown an end elevational view partially in section of the liquid distribution system of the vaporization cooled transformer shown in FIG. 1 of the drawing. End core 11 is shown with one coil 12 which has a conductor windings 13 embedded in insulating material 14 and has vertical ducts 15. Distribution pan 24 is positioned above and supported, for example, by insulating stand-offs 25 over core 11 and embedded conductor windings 13.

Pan 24 has its lower surface dished or depressed midway as shown in 32′ to provide for dielectric liquid distribution to apertures 30 and 31 with minimal liquid hold-up. The dielectric liquid is flowed over the top of core 11 from apertures 31 and on the wall surfaces of vertical ducts 15 of embedded windings 13 from apertures 30 to provide uniform cooling of both core 11 and embedded windings 13.

Figure 4:
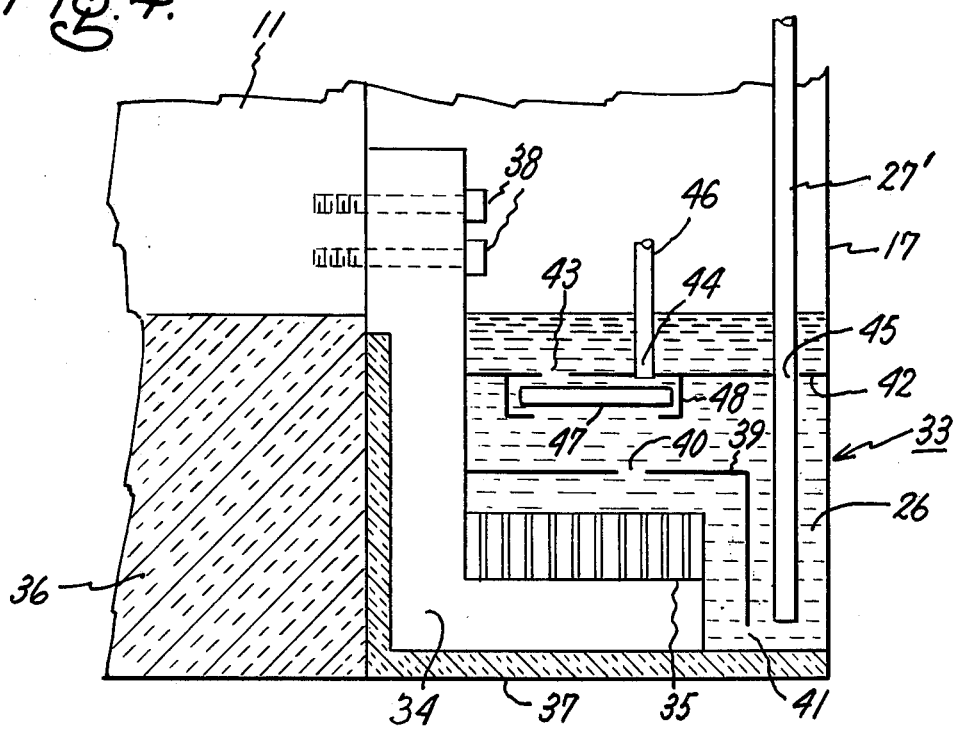
FIG. 4 is a schematic view of a modified condensate make-up pump which may be employed in the transformer shown in FIG. 1 of the drawing.

In FIG. 4, there is shown a condensate make-up pump 33 with an improved passive heating system. The modified condensate make-up pump 33 can be substituted for make-up pump 27 shown in FIG. 1 or similar make-up pumps which employ an active electric type heater. Heat is conducted from core 11 via a clamped heat conductor 34 made of a high conductivity material to a finned structure 35 immersed in dielectric liquid coolant 26. Core 11 is shown thermally insulated from liquid 26 by means of insulation 36 and 37. Heat conductor 34 is attached to core 11 in any suitable manner, for example, by bolts 38. Finned structure 35 is positioned on and in thermal contact with heat conductor 34. A cover 39 is provided generally around finned structure 35 and has an upper port 40 and a lower port 41 therein. A cover 42 for pump 33 has a dielectric liquid inlet port 43, a vapor outlet port 44 and a dielectric liquid outlet port 45. A tube 46 is attached to cover 42 and communicates with vapor outlet 44 to provide a vapor vent above the height of the dielectric liquid 26. A dielectric conduit 27′ extends through outlet port 45 and communicates with dielectric liquid distribution pan 24 (not shown in this figure). A flexible diaphragm 47 is positioned in alignment with ports 43 and 44 and is provided with suitable stop members 48 to limit the downward as well as lateral movement of diaphragm 47.

In the position shown in FIG. 4, ports 43 and 44 are open. As a result, liquid 26 enters port 43. When the liquid level reaches diaphragm 47, its buoyancy causes it to flow upward in the liquid thereby closing ports 43 and 44. Some of the liquid within pump 33 enters through port 41 of cover 39 around the finned structure 35 to be heated thereby. Heat is transferred from core 11 through heat conductor 34 to finned structure 35 and to the surrounding liquid thereby converting it to vapor which rises above finned structure 35 beneath cover 39. The vapor passes through port 40 in cover 39 into the body of liquid within pump 33 and exerts pressure on the liquid therebelow. The vapor contained in the upper portion of pump 33 also acts on the underside of diaphragm 47 to help maintained diaphragm 47 in a position closing both ports 33 and 34. The vapor in pump 33 exerts pressure on the liquid therein thereby pushing or forcing the liquid into conduit 27' which passes upwardly and into the liquid distribution pan 24 (not shown in this figure). When the liquid level in pump 33 has fallen and the vapor pressure has decreased, diaphragm 47 falls due to its weight and rests upon stop member 48.

While the above description of our invention sets forth a preferred improved liquid distribution system within a vaporization cooled transformer, it will be appreciated that other changes and modifications can be employed within the scope of this invention. The present vaporization cooled transformer provides a specific liquid distribution pan for containing a head of dielectric liquid while minimizing the volume of liquid hold-up, and for providing a flow of dielectric liquid over the top of the core and on wall surfaces of the vertical ducts of the embedded windings to provide uniform cooling, and a condensate make-up pump to provide additional liquid to the distribution pan. In this manner, substantially uniform cooling is provided for the vaporization cooled transformer. Other distribution pan designs can be employed provided they minimize the volume of liquid hold-up while providing suitable containment for a head of dielectric liquid. While a condensate make-up pump produces a more desirable cooling arrangement for the transformer, other means of supplying liquid to the distribution pan can be employed.

While other modifications of the invention and variations thereof which may be employed within the scope of the invention have not been distributed, the invention is intended to include such as may be embraced within the following claims.

What we claim as new and desire to secure by Letters Patents of the U.S. is:

1. A hermetically sealed vaporization chamber containing heat producing electrical apparatus to be cooled while dielectrically protected and two phase dielectric fluid comprising a liquid and a vapor, said apparatus including a plurality of cooling ducts extending vertically therethrough, said liquid residing at a bottom portion of the chamber and having a liquid level above the bottom of the chamber, said liquid also being distributed as a film which coats the top and the wall surfaces of the vertical ducts, said vapor being produced by vaporization of said liquid by said heat produced by said apparatus, said vapor occupying space in said chamber above said liquid level, a condenser having one end thereof connected to and communicating with an upper portion of said vaporization chamber occupied by said vapor, a reservoir containing a predetermined mass of non-condensable dielectric gas positioned above said condenser, said condenser having another end connected to and communicating with said reservoir and said gas therein, said gas forming an interfacial contact with said vapor in said condenser at a region therein between said ends of said condenser, said vapor condensing to form liquid condensate in the condenser on one said interfacial contact so that the effective condensation area of said condenser lies between said one end of said condenser and said interfacial contact; distribution means in said chamber positioned above said electrical apparatus for receiving liquid condensate from said condenser, said distribution means comprising a distribution pan with an outer rim, the rim portion of the distribution pan provided with a plurality of apertures to distribute the liquid condensate uniformly as a film over the wall surfaces of the associated vertical ducts, and at least one condensate make-up pump for pumping liquid from the bottom portion of the chamber to said distribution means.

2. A hermetically sealed vaporization chamber containing a vaporization cooled transformer to be cooled while dielectrically protected and two phase dielectric fluid comprising a liquid and a vapor, said transformer including a core and three coils, each coil having a plurality of cooling ducts extending vertically therethrough, said liquid residing at a bottom portion of the chamber and having a liquid level above the bottom of the chamber, said liquid also being distributed as a film which coats the top of the core and the wall surfaces of the vertical ducts, said vapor being produced by vaporization of said liquid by said heat produced by said apparatus, said vapor occupying space in said chamber above said liquid level, a condenser having one end thereof connected to and communicating with an upper portion of said vaporization chamber occupied by said vapor, a reservoir containing a predetermined mass of non-condensable dielectric gas positioned above said condenser, said condenser having another end connected to and communicating with said reservoir and said gas therein, said gas forming an interfacial contact with said vapor in said condenser at a region therein between said ends of said condenser, said vapor condensing to form liquid condensate in the condenser on one said interfacial contact so that the effective condensation area of said condenser lies between said one end of said condenser and said interfacial contact; distribution means in said chamber positioned above said transformer for receiving liquid condensate from said condenser, said distribution means comprising a distribution pan with an outer rim, three extended portions on two of the opposite edges of each distribution pan, each extended portion positioned above a portion of an associated coil, the rim portion of each extended portion provided with a plurality of apertures to distribute dielectric liquid as a film over the wall surfaces of the vertical ducts, the opposite two rim edges of the distribution pan provided with a plurality of apertures to distribute dielectric liquid as a film over the top of the core, the distribution pan depressed midway on its lower surfaces to provide containment for a head of dielectric liquid with minimum hold-up of the dielectric liquid, and at least one condensate make-up pump for pumping dielectric liquid from the bottom portion of the chamber to the distribution means.

3. In a hermetically sealed vaporation chamber as in claim 1, in which the condensate make-up pump has a heat conductor clamped to the core, the core is thermally insulated from the dielectric liquid, and a finned structure is in thermal contact with the heat conductor.

* * * * *